US008544476B1

(12) United States Patent
Marquardt et al.

(10) Patent No.: US 8,544,476 B1
(45) Date of Patent: Oct. 1, 2013

(54) HAIR STYLING APPARATUS

(76) Inventors: Christa Marquardt, Gonzales, LA (US); Robertson Marquardt, Gonzales, LA (US)

( * ) Notice: Subject to any disclaimer, the term of this patent is extended or adjusted under 35 U.S.C. 154(b) by 360 days.

(21) Appl. No.: 12/563,695

(22) Filed: Sep. 21, 2009

(51) Int. Cl.
*A45D 1/00* (2006.01)
*A45D 2/40* (2006.01)
*A45D 1/20* (2006.01)

(52) U.S. Cl.
USPC ..... 132/224; 132/233

(58) Field of Classification Search
USPC ..... 132/224, 225, 233, 229, 227, 232, 132/259, 260, 270, 269; 219/222–225, 251
See application file for complete search history.

(56) References Cited

U.S. PATENT DOCUMENTS

| | | | | | |
|---|---|---|---|---|---|
| 748,393 | A | * | 12/1903 | Martin | 132/259 |
| 1,719,232 | A | * | 7/1929 | Meade | 132/269 |
| 2,254,239 | A | | 5/1939 | Norman | |
| 3,250,895 | A | * | 5/1966 | McNair | 219/222 |
| 4,214,597 | A | | 7/1980 | Glassman | |
| 5,091,629 | A | | 2/1992 | McGee | |
| 5,223,694 | A | | 6/1993 | Tsuji et al. | |
| 5,676,871 | A | * | 10/1997 | Graves | 219/521 |
| 5,740,820 | A | | 4/1998 | Stern | |
| 5,861,607 | A | * | 1/1999 | Jarrett | 219/225 |
| 5,884,635 | A | | 3/1999 | O'Brien et al. | |
| 5,957,140 | A | | 9/1999 | McGee | |
| 6,114,661 | A | | 9/2000 | Leung | |
| 6,627,852 | B1 | * | 9/2003 | Savone | 219/225 |
| D506,851 | S | | 6/2005 | Schmitz | |
| 7,045,744 | B2 | * | 5/2006 | Oh | 219/225 |
| 7,445,012 | B2 | * | 11/2008 | Mukai | 132/224 |
| 7,600,520 | B2 | * | 10/2009 | Choi | 132/224 |
| 8,013,274 | B2 | * | 9/2011 | Suzuki et al. | 219/225 |
| 2006/0201527 | A1 | * | 9/2006 | Higgins et al. | 132/225 |
| 2008/0173322 | A1 | | 7/2008 | Leung | |
| 2008/0210255 | A1 | | 9/2008 | Moll | |
| 2009/0032048 | A1 | | 2/2009 | Suzuki et al. | |

* cited by examiner

*Primary Examiner* — Robyn Doan
(74) *Attorney, Agent, or Firm* — Jones Walker LLP

(57) ABSTRACT

In the specification and drawings a hair styling apparatus is described and shown with a first barrel half, a second barrel half, and a handle, the handle being releasably attached to the first barrel half and releasably attached to the second barrel half.

8 Claims, 8 Drawing Sheets

HAIR STYLING APPARATUS

I. BRIEF DESCRIPTION OF THE SEVERAL VIEWS OF THE DRAWINGS

II. DETAILED DESCRIPTION

Figure 1:
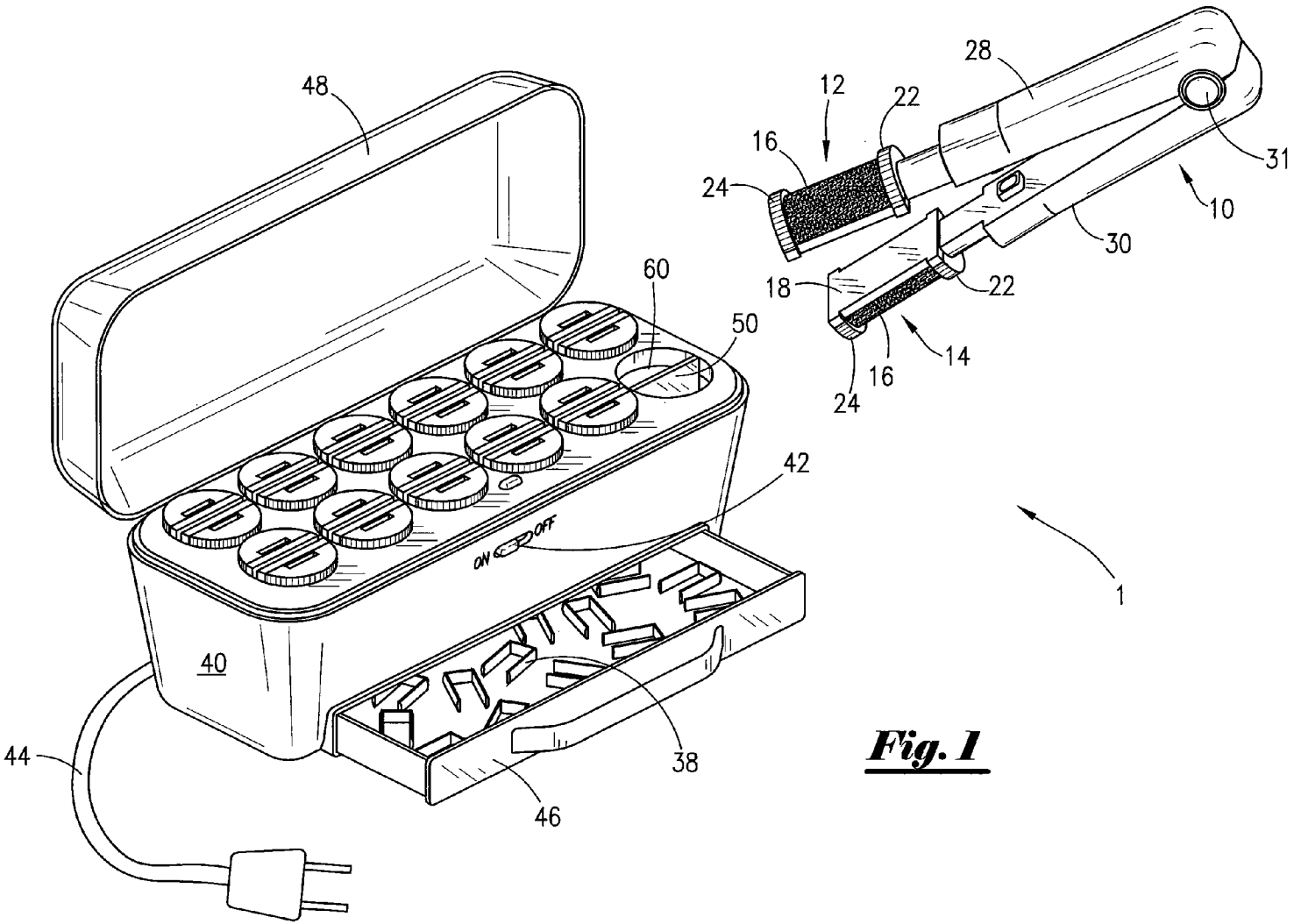
FIG. 1 is a perspective view of an embodiment described herein.

As shown in the accompanying drawings, an embodiment is a hair styling apparatus 1. As shown in FIG. 1, an embodiment of the hair styling apparatus 1 has a first barrel half 12 and a second barrel half 14. A handle 10 is releasably attached to the first barrel half 12 and the second barrel half 14.

Figure 2:
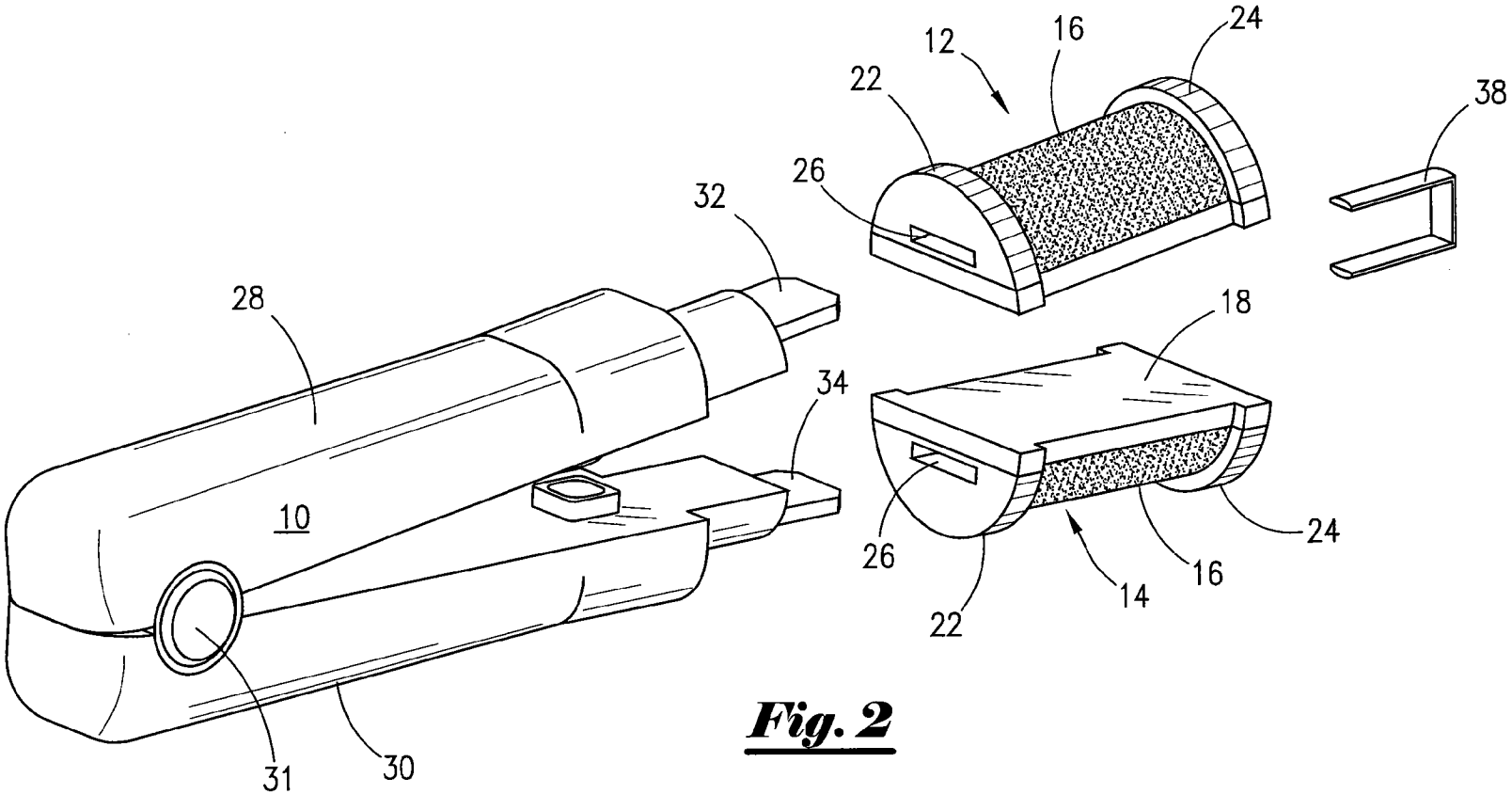
FIG. 2 is an exploded perspective view of an embodiment described herein.

Referring to the embodiments shown in FIGS. 1, and 2, the first barrel half 12 and the second barrel half 14 have a rounded exterior surface 16 and a flat interior surface 18. The rounded exterior surface 16 and/or the flat interior surface 18 can contain a heat conducting material such as plastic, ceramic, or metal. Although the embodiment of the first barrel half 12 and the second barrel half 14 shown in FIGS. 1, and 2 depicts two symmetrical pieces, the first barrel half 12 and second barrel half 14 can also be non-symmetrical pieces, as is shown in the embodiment depicted in FIGS. 5-8. The combined first barrel half 12 and the second barrel half 14 can be cylindrical or substantially cylindrical and can be a curler suitable for curling hair.

Figure 3:
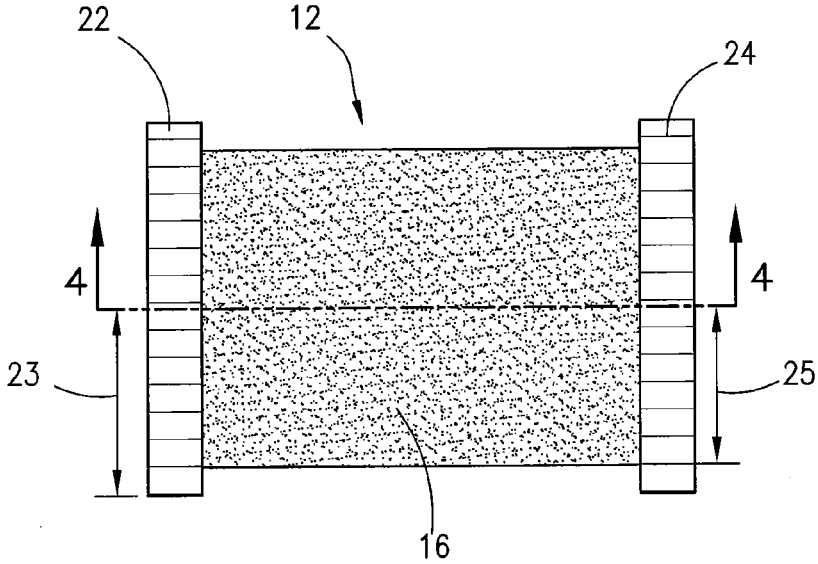
FIG. 3 is a plan view of an embodiment described herein.

Referring to the embodiments shown in FIGS. 1, and 2, the first barrel half 12 and the second barrel half 14 can have an upper rim 22 and a lower rim 24. As shown in the embodiment depicted in FIG. 3, the upper rim 22 and the lower rim 24 can have a radius 23 which is greater than the radius 25 of the first barrel half 12 and the second barrel half 14. As shown in the embodiment depicted in FIG. 4, the upper rim 22 and the lower rim 24 can each have an aperture 26. The apertures 26 on the upper rim 22 and the lower rim 24 can be the same size or different sizes.

Figure 4:
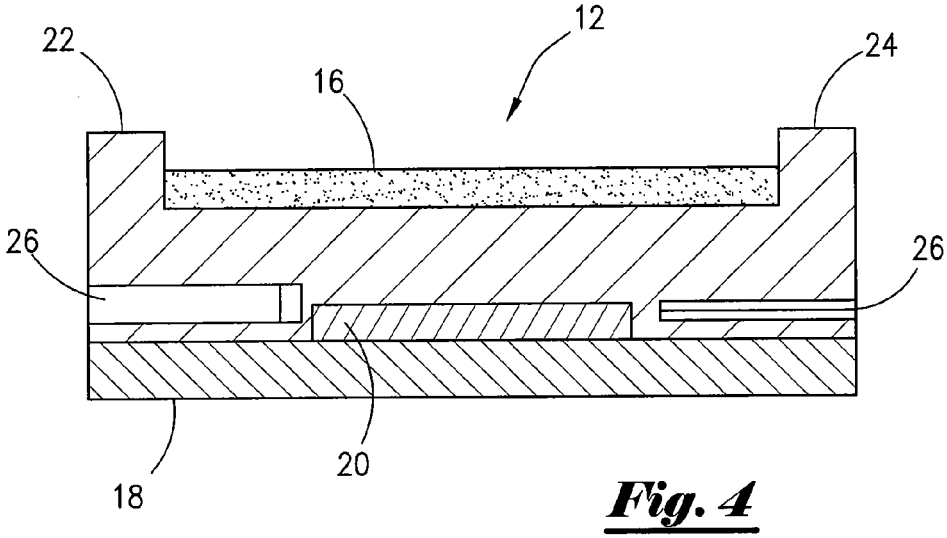
FIG. 4 is a sectional view taken along line 4-4 of FIG. 3.

Referring to the embodiment shown in FIG. 4, the first barrel half 12 and/or the second barrel half 14 (not shown in FIG. 4) can also contain a magnet 20. As shown in FIG. 4, the magnet 20 can be positioned behind the flat interior surface 18. Although the embodiment of the magnet 20 shown in FIG. 4 depicts the magnet 20 behind the flat interior surface 18, the magnet can be positioned behind the rounded exterior surface 16. In an embodiment, the flat interior surface 18 can be formed of a material which is itself magnetic. In an embodiment, magnets located in each of the first barrel half and the second barrel half can serve to secure the first barrel half to the second barrel half.

Referring now to the embodiments shown in FIGS. 1 and 2, the handle 10 includes a first arm 28 and a second arm 30. In an embodiment, the first arm 28 and the second arm 30 can be pivotally connected at pivot 31. The pivot 31 can be an apparatus such as a hinge, nut and bolt, screw, or any other connection that allows the first arm 28 to pivot relative to the second arm 30. The distal end of the first arm 28 has a protrusion 32 (see FIG. 2), and the distal end of the second arm 30 has a protrusion 34 (see FIG. 2). In the embodiment shown in FIG. 2, the protrusion 32 of the first arm 28 is complementary with the aperture 26 of the upper rim 22 of the first barrel half 12; and the protrusion 34 of the second arm 30 is complementary with the aperture 26 of the upper rim 22 of the second barrel half 14. The protrusion 32 can be releaseably attached to the first barrel half 12 by inserting the protrusion 32 into the aperture 26 of the upper rim 22 of the first barrel half 12; and the protrusion 34 can be releaseably attached to the second barrel half 14 by inserting the protrusion 34 into the aperture 26 of the upper rim 22 of the second barrel half 14.

The first arm 28 and the second arm 30 can also contain a locking mechanism. The locking mechanism can be any mechanism which retains either or both of the first arm 28 and the second arm 30 in the position of releasable attachment to either or both the first barrel half 12 and the second barrel half 14.

Although the embodiments shown in FIGS. 1, 2, 5, and 6 show a non-heated handle 10, the handle 10 can also contain a heating element, and a power cord. The heating element can be a part of the protrusion 34 or can be a separate part of the handle 10. Additionally, in such an embodiment the power cord can provide electricity to the handle 10 in order to heat the heating element.

Referring now to FIGS. 5 through 8, in an embodiment the first barrel half 12 can have a concave interior surface 35, and the second barrel half 14 can have a convex interior surface 37.

Figure 5:
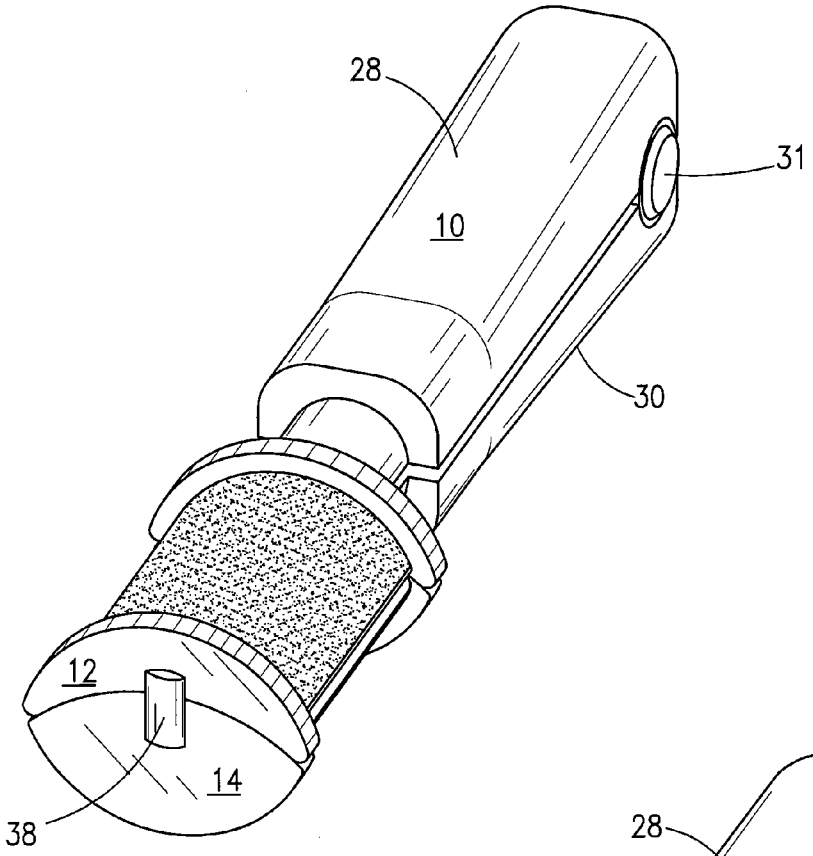
FIG. 5 is a perspective view of an embodiment described herein.
Figure 6:
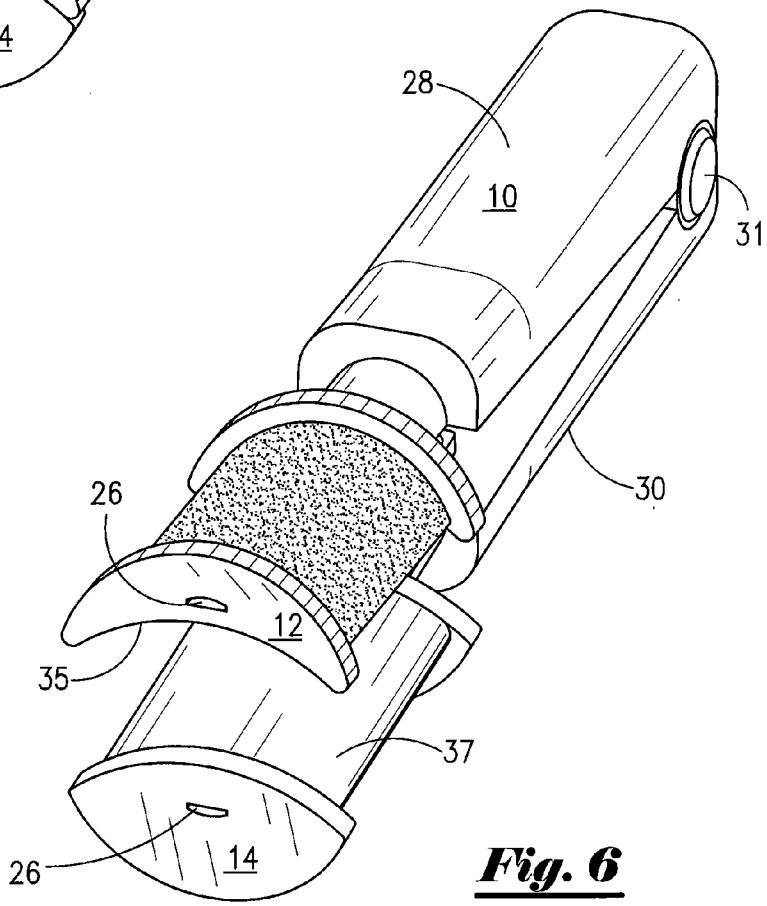
FIG. 6 is a perspective view of an embodiment described herein.
Figure 7:
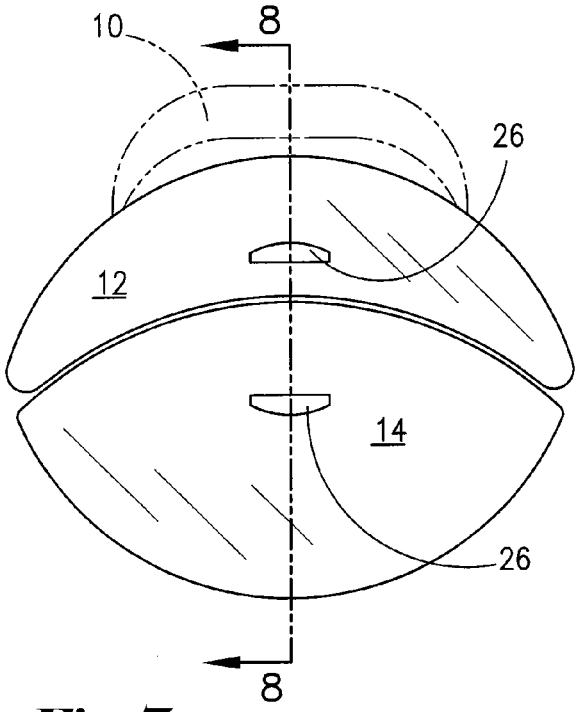
FIG. 7 is a side elevation view of an embodiment described herein.
Figure 8:
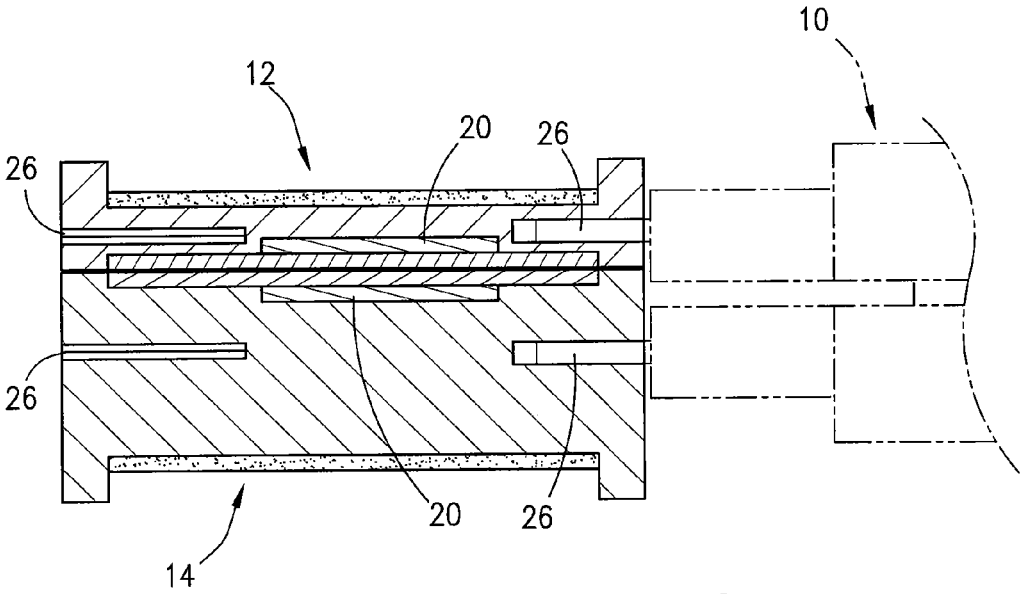
FIG. 8 is a sectional view taken along line 8-8 of FIG. 7.

Referring to the embodiment shown in FIGS. 2, and 5, a clip 38 can be used to connect the first barrel half 12 to the second barrel half 14. As shown in FIGS. 2, and 5, the clip 38 can be generally "U" shaped and can fit into the aperture 26 of the upper rim 22 of the first barrel half 12, and simultaneously fit into the aperture 26 of the upper rim 22 of the second barrel half 14, thereby securing the first barrel half 12 to the second barrel half 14. The combined first barrel half 12 and second barrel half 14 can form a cylinder which can be suitable for curling hair. The clip can also be designed to fit around the rounded exterior surface 16 of the completed cylinder formed by the first barrel half 12 and the second barrel half 14. In an embodiment, the clip can be any shape which holds the completed cylinder securely in the hair, such as after detachment from the handle 10.

Figure 9:
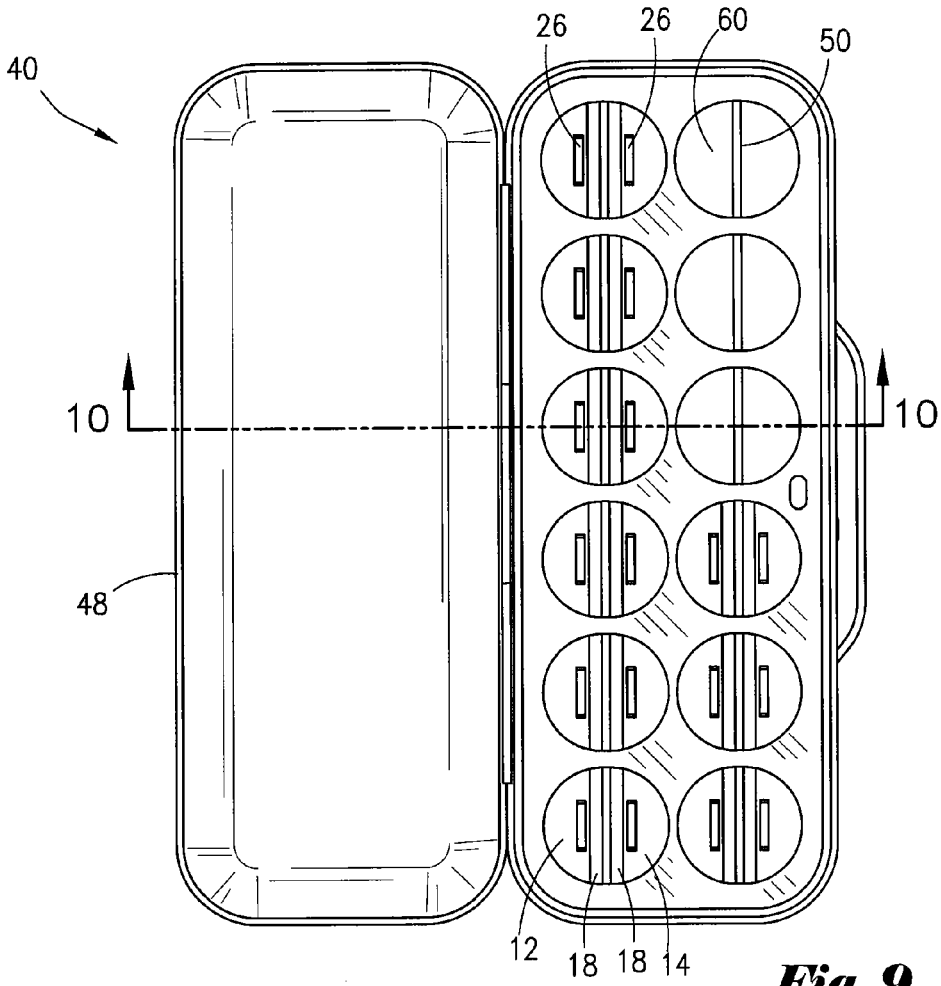
FIG. 9 is a plan view of an embodiment described herein.
Figure 10:
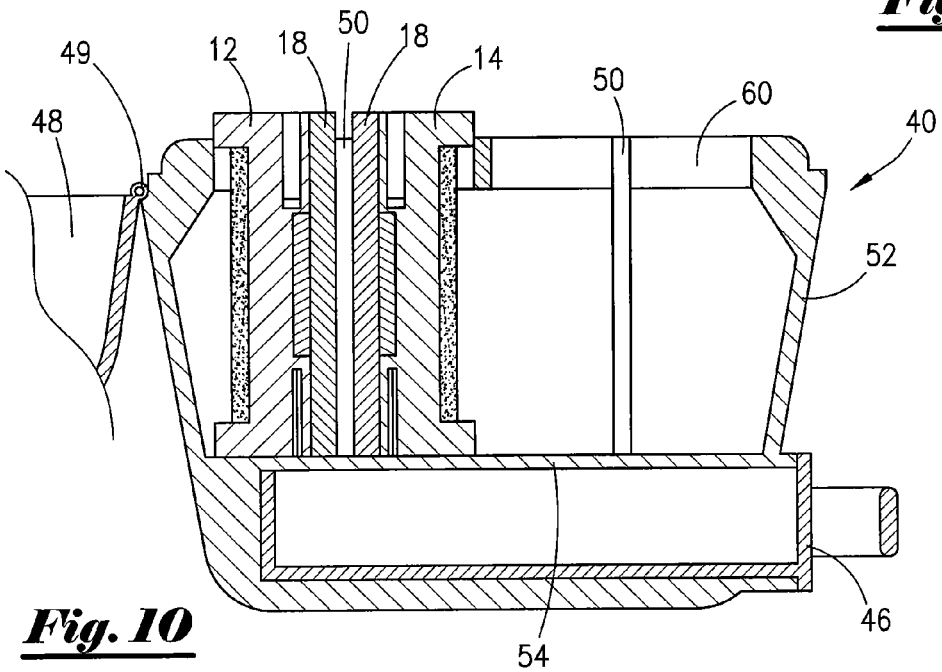
FIG. 10 is a sectional view taken along line 10-10 of FIG. 9.

Referring now to the embodiment shown in FIGS. 1, 9, and 10, the hair styling apparatus can also include a case 40. Although the embodiments depicted in FIGS. 1, 9, and 10 show a rectangular case 40, in an embodiment the case can be square, round, or any other shape which can hold a plurality of first barrel halves 12 and second barrel halves 14. The case 40 can have a power switch 42, a power cord 44, and a drawer 46. Although the embodiment depicted in FIG. 1 has one drawer 46, in an embodiment the case 40 can have two or more drawers. In still another embodiment, the case can be provided without any drawers.

Additionally, as shown in FIGS. 1, 9, and 10, the case 40 can have a cover 48. As shown in FIG. 10, the cover 48 can be hingedly connected to the case 40 at hinge 49. The case 40 and/or the cover 48 can be composed of plastic, metal, glass or any other material and can be transparent, translucent, or opaque.

Referring still to the embodiments depicted in FIGS. 1, 9, and 10, the case 40 can contain a plurality of slots 60. The slots 60 can be adapted to receive a first barrel half 12 and a complementary second barrel half 14. The case 40 can also contain a heating element 50. In the embodiments shown in FIGS. 1, 9, and 10, the heating element 50 is a plate which extends between the first barrel halves 12 and the second barrel halves 14 and can heat the flat interior surface 18 of the first barrel half 12 and the second barrel half 14 via direct or substantially direct contact. In this embodiment, the heating element 50 can heat the rounded exterior surface 16 of the first barrel half 12 and the second barrel half 14 via indirect contact. In another embodiment, the heating element 50 can be individual rods which insert into the first barrel halves 12 and the second barrel halves 14. In still another embodiment, the heating element 50 can be in the walls 52 of the case and/or in the bottom 54 of the case 40, and can heat both the rounded exterior surface 16 and the flat interior surface 18 via indirect contact. In an embodiment, the power cord 44 can connect to a electrical outlet to provide the electricity for the heating element 50. In still another embodiment, the case 40 can be provided with a portable power source such as a battery or a rechargeable battery. In such an embodiment, the power cord 44 can be eliminated, or the power cord 44 can be retained and can provide a means to recharge a rechargeable battery.

Figure 11:
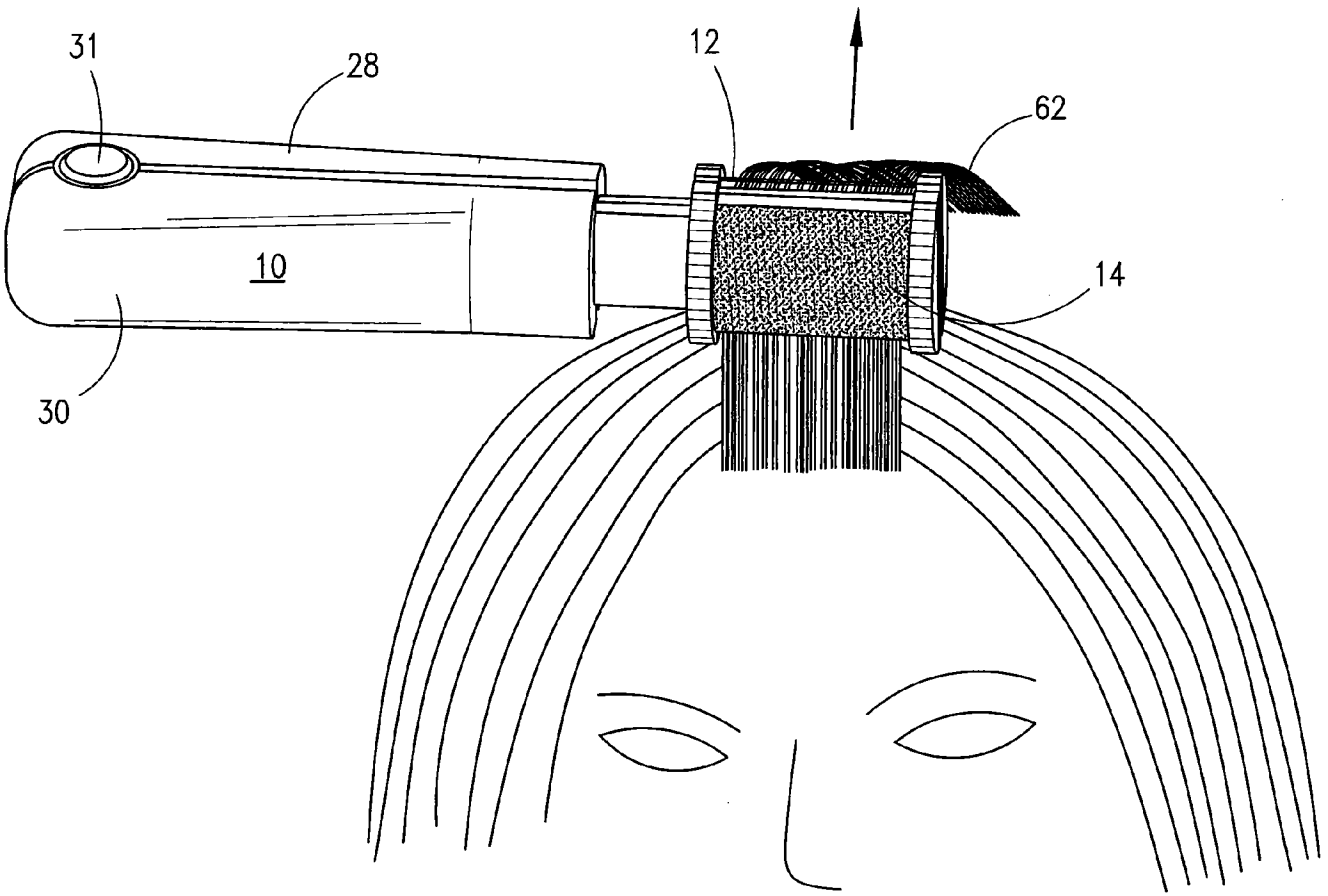
FIG. 11 is a perspective view of an embodiment described herein.

Referring now to FIGS. 1, 2 and 11, in operation of an embodiment a first barrel half 12 and a second barrel half 14 are heated in a case 40 by heating element 50. The heated first barrel half 12 and second barrel half 14 are both then attached to the handle 10. The first barrel half 12 can be attached to the first arm 28 by inserting a protrusion 32 of the first arm 28 into the aperture 26 of the upper rim 22 of the first barrel half. The second barrel half 14 can be attached to the second arm 30 by inserting a protrusion 34 of the second arm 30 into the aperture 26 of the upper rim 22 of the second barrel half 14. A separated piece of hair 62 is then placed between the flat interior surfaces 18 of the first barrel half 12 and the second barrel half 14. The first barrel half 12 and second barrel half 14 are then pulled from root to tip of the separated piece of hair 62. The process of pulling the first barrel half 12 and the second barrel half 14 from root to tip of the separated piece of hair 62, combined with heat emitted from the flat interior surface 18, can straighten the separated piece of hair 62.

Figure 12:
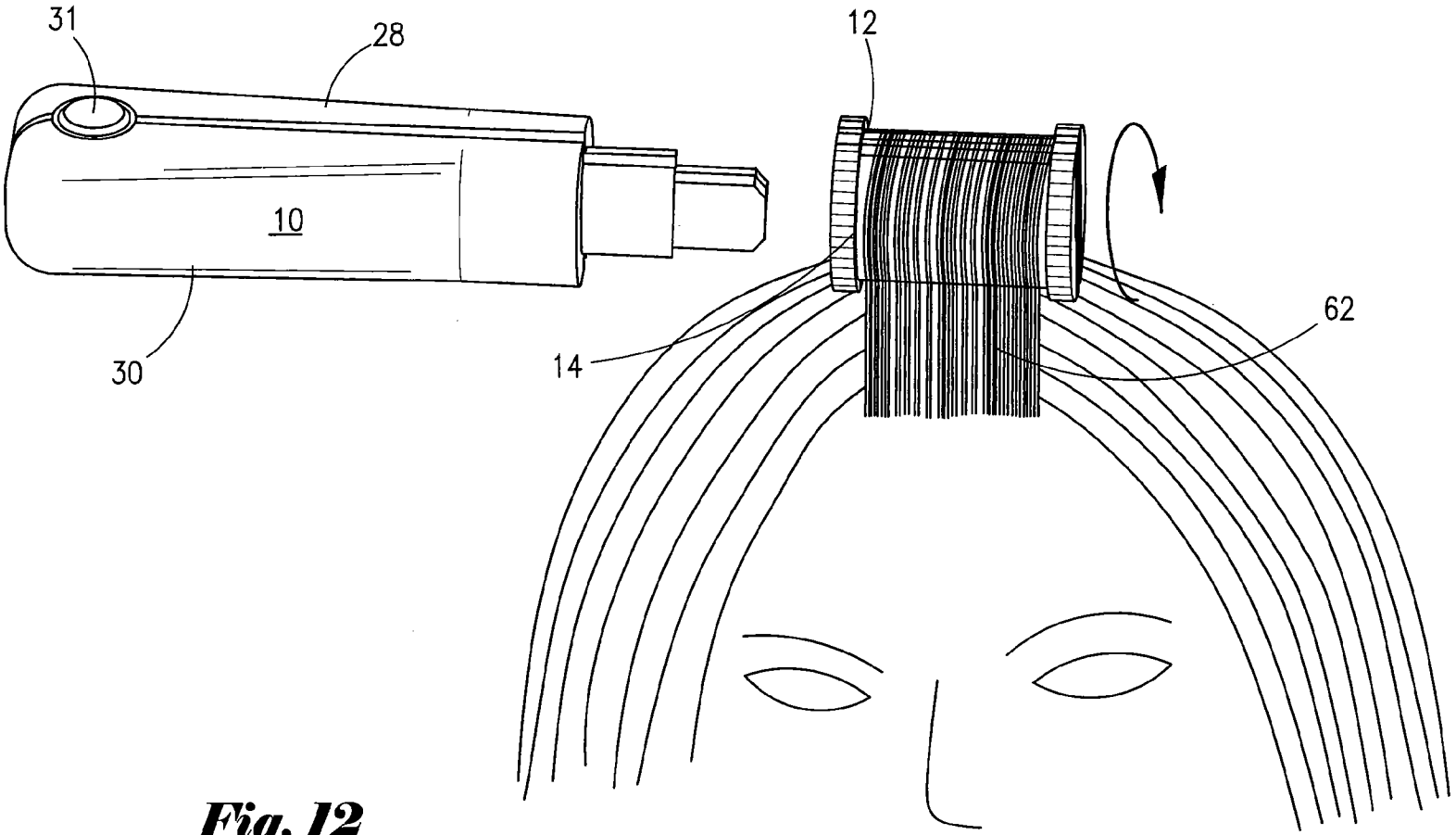
FIG. 12 is a perspective view of an embodiment described herein.

Referring to the embodiment shown in FIG. 12, the separated piece of hair 62 is then rolled about the first barrel half 12 and second barrel half 14. In an embodiment, the separated piece of hair 62 can remain between the flat interior surfaces 18 of the first barrel half 12 and the second barrel half 14 as the separated piece of hair 62 is rolled about the first barrel half 12 and the second barrel half 14. In another embodiment, the separated piece of hair 62 can be removed from between the flat interior surfaces 18 of the first barrel half 12 and the second barrel half 14, and the separated piece of hair 62 can then be rolled about the first barrel half 12 and the second barrel half 14. The first barrel half 12 and second barrel half 14 are then secured together with the separated piece of hair still wrapped around the completed cylinder. The first barrel half 12 and the second barrel half 14 are then separated from the handle 10. In an embodiment, the first barrel half 12 and the second barrel half 14 can be separated from the handle 10 by pulling the handle 10 in one direction and the first barrel half 12 and the second barrel half 14 in an opposite direction. In another embodiment, the first barrel half 12 and the second barrel half 14 can be separated from the handle 10 by disengaging a locking mechanism located on the first arm 28 and/or second arm 30 of the handle 10. The first barrel half 12 and the second barrel half 14 are then left in the separated piece of hair 62 for a desired time. The desired time is the time necessary to achieve the style of hair intended by the user. The first barrel half 12 and the second barrel half 14 are then removed from the separated piece of hair 62. One or more of the steps of this process can then be repeated with additional first barrel halves and second barrel halves.

The embodiments shown in the drawings and described above are exemplary of numerous embodiments that may be made within the scope of the appended claims. It is contemplated that numerous other configurations may be used, and the material of each component may be selected from numerous materials other than those specifically disclosed. In short, it is the applicant's intention that the scope of the patent issuing herefrom will be limited only by the scope of the appended claims.

We claim:

1. A hair styling apparatus comprising:

a) a case, the case comprising:
   i) a power switch connected to said case;
   ii) a drawer within said case;
   iii) a plurality of slots within said case; and
   iv) a heating element dividing each of said plurality of slots into a first sub-slot and a second sub-slot;

b) a plurality of first barrel halves, each of said first barrel halves having a rounded exterior surface and a flat interior surface, at least one of said plurality of first barrel halves being located within said first sub-slot such that said flat interior surface is adjacent to said heating element;

c) a plurality of second barrel halves, each of said second barrel halves having a rounded exterior surface and a flat interior surface, at least one of said plurality of second barrel halves being located within said second sub-slot such that said flat interior surface is adjacent to said heating element;

d) a handle, the handle comprising a first arm with a protrusion at the distal end of the first arm and a second arm with a protrusion at the distal end of the second arm, said first arm being pivotally connected to said second arm, said protrusion of said first arm being releasably attached to at least one of said first barrel halves, and said protrusion of said second arm being releasably attached to at least one of said second barrel halves; and e) a plurality of clips contained within said drawer, each of said clips being adapted to secure at least one of said first barrel halves to at least one of said second barrel halves.

2. The hair styling apparatus of claim 1 wherein said rounded exterior surface and said flat interior surface further comprise a heat conducting material.

3. The hair styling apparatus of claim 1 wherein at least one of said plurality of first barrel halves and at least one of said plurality of second barrel halves further comprise a magnet.

4. The hair styling apparatus of claim 1 wherein at least one of said plurality of first barrel halves and at least one of said plurality of second barrel halves each further comprise an upper rim and a lower rim.

5. The hair styling apparatus of claim 4 wherein the radius of said upper rim and said lower rim of said at least one of said plurality of first barrel halves is greater than the radius of said at least one of said plurality of first barrel halves; and the radius of said upper rim and said lower rim of said at least one of said plurality of second barrel halves is greater than the radius of said at least one of said plurality of second barrel halves.

6. The hair styling apparatus of claim 5 wherein said upper rim of said at least one of said plurality of first barrel halves comprises an aperture; and said upper rim of said at least one of said plurality of second barrel halves comprises an aperture.

7. The hair styling apparatus of claim 1 further comprising a means for lockably attaching at least one of said first arm and said second arm to at least one of said plurality of first barrel halves and said plurality of second barrel halves.

8. The hair styling apparatus of claim 1 wherein said protrusion of said first arm is complementary with an aperture of at least one of said first barrel halves; and said protrusion of said second arm is complementary with an aperture of at least one of said second barrel halves.

* * * * *